US011749171B2

(12) United States Patent
Wai et al.

(10) Patent No.: US 11,749,171 B2
(45) Date of Patent: Sep. 5, 2023

(54) METHOD FOR DISPLAYING IMAGE IN MULTI DISPLAY DRIVE CIRCUIT SYSTEM AND ELECTRONIC DEVICE

(71) Applicant: Huawei Technologies Co., Ltd., Shenzhen (CN)

(72) Inventors: Dustin Yuk Lun Wai, Shenzhen (CN); Kun Wang, Shanghai (CN); Anli Wang, Shenzhen (CN); Liang Wang, Shanghai (CN); Chiaching Chu, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 38 days.

(21) Appl. No.: 17/433,209

(22) PCT Filed: Feb. 18, 2020

(86) PCT No.: PCT/CN2020/075711
§ 371 (c)(1),
(2) Date: Aug. 23, 2021

(87) PCT Pub. No.: WO2020/169026
PCT Pub. Date: Aug. 27, 2020

(65) Prior Publication Data

US 2022/0208073 A1 Jun. 30, 2022

(30) Foreign Application Priority Data

Feb. 23, 2019 (WO) ..... PCT/CN2019/075982
Sep. 5, 2019 (CN) ..... 201910837787.X

(51) Int. Cl.
*G09G 5/02* (2006.01)
*G09G 3/20* (2006.01)

(52) U.S. Cl.
CPC ... *G09G 3/2096* (2013.01); *G09G 2300/0443* (2013.01); *G09G 2300/0452* (2013.01);
(Continued)

(58) Field of Classification Search
CPC ..... G09G 3/2096; G09G 2300/0443; G09G 2300/0452; G09G 2340/0457
(Continued)

(56) References Cited

U.S. PATENT DOCUMENTS

2004/0051724 A1 3/2004 Elliott et al.
2010/0118045 A1 5/2010 Brown Elliott et al.
(Continued)

FOREIGN PATENT DOCUMENTS

CN 103413515 A 11/2013
CN 103995379 A 8/2014
(Continued)

OTHER PUBLICATIONS

"Optical information processing, image recognition," Chinese Optics and Applied Optics Abstracts, Issue 02, 2008, with the English translation, 27 pages.
(Continued)

*Primary Examiner* — Jonathan M Blancha
(74) *Attorney, Agent, or Firm* — HUAWEI TECHNOLOGIES CO., LTD.

(57) ABSTRACT

An electronic device includes a host controller. The host controller splits a to-be-displayed image into at least two sub images, where each sub image and an adjacent sub image thereof include at least one column of overlapping image pixels. The host controller sends the at least two sub images to at least two display drive circuits, so that the at least two display drive circuits can jointly drive a display screen to display the to-be-displayed image in a sub pixel rendering (SPR) manner.

20 Claims, 11 Drawing Sheets

(52) U.S. Cl.
CPC . *G09G 2340/0457* (2013.01); *G09G 2340/14* (2013.01); *G09G 2360/06* (2013.01)

(58) Field of Classification Search
USPC ..... 345/694
See application file for complete search history.

(56) References Cited

U.S. PATENT DOCUMENTS

| | | | | |
|---|---|---|---|---|
| 2010/0149204 | A1 | 6/2010 | Han | |
| 2010/0201702 | A1* | 8/2010 | Franik | G09G 3/001 345/589 |
| 2010/0321697 | A1 | 12/2010 | Zheng et al. | |
| 2011/0025669 | A1 | 2/2011 | Kwak et al. | |
| 2012/0287147 | A1 | 11/2012 | Brown Elliott et al. | |
| 2013/0208082 | A1 | 8/2013 | Williams et al. | |
| 2014/0232757 | A1 | 8/2014 | Nakahata | |
| 2014/0362127 | A1 | 12/2014 | Yang et al. | |
| 2015/0339967 | A1* | 11/2015 | Shin | G09G 3/2003 345/690 |
| 2015/0364075 | A1 | 12/2015 | Sato et al. | |
| 2017/0186359 | A1* | 6/2017 | Lee | G09G 3/2003 |
| 2018/0286328 | A1* | 10/2018 | Nakanishi | G09G 3/2051 |
| 2018/0336864 | A1* | 11/2018 | Wang | G09G 5/02 |
| 2020/0152126 | A1* | 5/2020 | Jo | H10K 59/351 |

FOREIGN PATENT DOCUMENTS

| | | | |
|---|---|---|---|
| CN | 106997579 | A | 8/2017 |
| CN | 107633795 | A | 1/2018 |
| CN | 108269535 | A | 7/2018 |
| JP | 2016001290 | A | 1/2016 |
| KR | 20080043996 | A | 5/2008 |
| KR | 20080084173 | A | 9/2008 |
| KR | 20120065565 | A | 6/2012 |
| WO | 2001029817 | A1 | 4/2001 |
| WO | 2009070913 | A1 | 6/2009 |

OTHER PUBLICATIONS

Shen, J., et al., "Virtual Mirror Rendering With Stationary RGB-D Cameras and Stored 3-D Background," IEEE Transactions on Image Processing, vol. 22, No. 9, Sep. 2013, 16 pages.

* cited by examiner

METHOD FOR DISPLAYING IMAGE IN MULTI DISPLAY DRIVE CIRCUIT SYSTEM AND ELECTRONIC DEVICE

CROSS-REFERENCE TO RELATED APPLICATIONS

This application is a National Stage of International Patent Application No. PCT/CN2020/075711 filed on Feb. 18, 2020, which claims priority to Chinese Patent Application No. 201910837787.X filed on Sep. 5, 2019, and International Patent Application No. PCT/CN2019/075982 filed on Feb. 23, 2019. All of the aforementioned patent applications are hereby incorporated by reference in their entireties.

TECHNICAL FIELD

This application relates to the image display field, and in particular, to a method for displaying an image in a multi display drive circuit system and an electronic device.

BACKGROUND

A digital image generally includes several image pixels, and each image pixel includes a finite quantity of discrete color components. A conventional image pixel includes red (red), green (green), and blue (blue) color components. A plurality of screen pixels arranged in an array on a display screen are driven based on the digital image, so that the digital image can be displayed on the display screen.

When the displaying is performed according to a conventional sub pixel driving method, one screen pixel includes three sub pixels: red, green and blue, and each sub pixel is used to display one color component of an image pixel. To improve a resolution of the display screen, a quantity of screen pixels needs to be increased. However, in a screen pixel circuit design, an area for placing a single screen pixel in an active area of a panel is limited. After the quantity of screen pixels reaches a degree, it is difficult to continue to increase the quantity, and it is difficult to continue to improve the resolution of the display screen. Therefore, a sub pixel rendering (sub pixel rendering, SPR) algorithm is proposed. In the SPR algorithm, three color components of an image pixel are displayed by one SPR pixel with fewer sub pixels on the screen, but a visual effect same as that of three sub pixels of a conventional screen pixel may be achieved. Currently, one SPR pixel includes two sub pixels.

A basic principle of the SPR algorithm is to compute pixel data of a target SPR pixel by using pixel data of nearby SPR pixels, for example, pixel data of upper, lower, left, and right SPR pixels, for reference. However, in a system including two display drive circuits (hereinafter referred to as the system with two display drive circuits), a host controller splits an image into two parts and sends the two parts to the two display drive circuits respectively. The two display drive circuits must share pixel data to render the image based on the SPR algorithm. An existing method for implementing pixel data sharing between the two display drive circuits is to establish, between the two display drive circuits, a data channel (that is, an interface) specially used for exchanging pixel data between the two display drive circuits.

However, to facilitate establishment of the data channel, a size of the display drive circuit needs to be larger, so that a flexible printed circuit (flexible printed circuit, FPC) area is increased. In addition, establishing the data channel between the two display drive circuits inevitably brings about problems such as electromagnetic interference (electro-magnetic interference, EMI) and electrostatic discharge (electro-static discharge, ESD) between the two display drive circuits.

SUMMARY

This application provides an electronic device and a method for displaying an image in a multi display drive circuit system, to avoid problems of FPC area increase, EMI, and ESD when the multi display drive circuit system displays an image.

According to a first aspect, this application provides an electronic device, including a host controller, a display screen, and at least two display drive circuits, where the at least two display drive circuits drive the display screen to display an image;

the host controller is configured to split a to-be-displayed image into at least two sub images in a non sub pixel rendering SPR pixel format, and send the at least two sub images to the at least two display drive circuits, where each sub image and an adjacent sub image thereof include at least one column of overlapping image pixels; and each of the at least two display drive circuits is configured to receive one of the at least two sub images from the host controller, and drive, based on pixel data of the sub image in the non SPR pixel format, the display screen to display a part of the to-be-displayed image in an SPR manner, where the at least two display drive circuits drive each part displayed on the display screen to jointly present the to-be-displayed image.

It should be understood that the multi display drive circuit system is a system that includes multiple display drive circuits. The multi display drive circuit system may include two or more display drive circuits.

In the technical solution of this application, the host controller in the electronic device splits the to-be-displayed image into the at least two sub images, where each sub image includes one or more columns of image pixels that are located at a boundary between the sub image and the adjacent sub image thereof and belong to the adjacent sub image. The host controller sends the at least two sub images to the at least two display drive circuits in the multi display drive circuit system. Because the sub image received by each display drive circuit includes one or more columns of image pixels that are located at the boundary between the sub image and the adjacent sub image thereof and belong to the adjacent sub image, each display drive circuit may drive, based on a non SPR pixel included in the received sub image and based on a principle of an SPR technology, the display screen to display the sub image in the SPR manner. Each of the at least two display drive circuits drives the display screen to display a part of the to-be-displayed image, so that the at least two display drive circuits drive each part displayed on the display screen to jointly present the to-be-displayed image. It can be learned that the display drive circuits in the multi display drive circuit system can display the image without establishing a data channel between the display drive circuits, thereby avoiding problems such as FPC area increase, EMI, and ESD caused by establishing the data channel.

With reference to the first aspect, in some implementations of the first aspect, the electronic device specifically includes a first display drive circuit and a second display drive circuit, where the host controller is configured to split the to-be-displayed image into a first sub image and a second sub image in the non SPR pixel format, send the first sub image to the first display drive circuit, and send the second sub image to the second display drive circuit, where the first sub image and the second sub image include at least one column of overlapping image pixels;

the first display drive circuit is configured to drive, based on pixel data of the first sub image in the non SPR pixel format, the display screen to display a part of the to-be-displayed image in the SPR manner; and the second display drive circuit is configured to drive, based on pixel data of the second sub image in the non SPR pixel format, the display screen to display another part of the to-be-displayed image in the SPR manner.

With reference to the first aspect, in some implementations of the first aspect, that the first sub image and the second sub image include at least one column of overlapping image pixels includes: a column range of image pixels included in the first sub image is $[1, M+N_1]$, and a column range of image pixels included in the second sub image is $[M-N_2, Z]$, where Z is a total quantity of columns of image pixels included in the to-be-displayed image, Z, M, $N_1$, and $N_2$ are all positive integers, $1<M<Z$, and $Z>1$.

In an implementation, $N_1=N_2$, indicating that a quantity of columns of image pixels of the second sub image adjacent to the first sub image, included in the first sub image, is equal to a quantity of columns of image pixels of the first sub image adjacent to the second sub image, included in the second sub image.

Optionally, $M=Z/2$, indicating that the two display drives respectively drive the display screen to display half of the to-be-displayed image.

In some implementations of the first aspect, N=8 or 16.

According to a second aspect, another electronic device is provided, including a host controller, a display screen, and at least two display drive circuits, where the host controller is configured to generate at least two sub images in an SPR pixel format based on pixel data of a to-be-displayed image in a non SPR pixel format, and send the at least two sub images to the at least two display drive circuits; and each of the at least two display drive circuits is configured to receive one of the at least two sub images from the host controller, and drive the display screen to display a part of the to-be-displayed image in an SPR manner, where the at least two display drive circuits drive each part displayed on the display screen to jointly present the to-be-displayed image.

In the technical solution of this application, the host controller in the electronic device outputs a rendered sub image (that is, a sub image in the SPR pixel format) to each display drive circuit in the multi display drive circuit system. Therefore, each display drive circuit may directly drive, based on pixel data of the received sub image in the SPR pixel format, the display screen to display the received sub image in the SPR manner. Each display drive circuit in the multi display drive circuit system drives the display screen to display one sub image, so that the at least two display drive circuits drive each sub image displayed on the display screen to jointly present the to-be-displayed image. It can be learned that the display drive circuits in the multi display drive circuit system can display the image without establishing a data channel between the display drive circuits, thereby avoiding problems such as FPC area increase, EMI, and ESD caused by establishing the data channel.

With reference to the second aspect, in some implementations of the second aspect, the electronic device includes a first display drive circuit and a second display drive circuit, where the host controller is configured to generate a third sub image and a fourth sub image in the SPR pixel format based on the pixel data of the to-be-displayed image in the non SPR pixel format, send the third sub image to the first display drive circuit, and send the fourth sub image to the second display drive circuit:

the first display drive circuit is configured to drive the display screen to display the third sub image in the SPR manner: and the second display drive circuit is configured to drive the display screen to display the fourth sub image in the SPR manner.

According to a third aspect, this application provides a method for displaying an image in a multi display drive circuit system, where the multi display drive circuit system includes a host controller, a display screen, and at least two display drive circuits, and the method includes the following steps: The host controller splits a to-be-displayed image into at least two sub images in a non sub pixel rendering SPR pixel format, and sends the at least two sub images to the at least two display drive circuits, where each sub image and an adjacent sub image thereof include at least one column of overlapping image pixels; and each of the at least two display drive circuits receives one of the at least two sub images from the host controller, and drives, based on pixel data of the sub image in the non SPR pixel format, the display screen to display a part of the to-be-displayed image in an SPR manner, where the at least two display drive circuits drive each part displayed on the display screen to jointly present the to-be-displayed image.

It should be understood that the method for displaying an image in a multi display drive circuit system in the third aspect and the electronic device in the first aspect are based on a same inventive concept. Therefore, for beneficial technical effects that can be achieved by the technical solution in the third aspect, refer to the description in the first aspect. Details are not described again.

With reference to the third aspect, in some implementations of the third aspect, the multi display drive circuit system includes a first display drive circuit and a second display drive circuit, where that the host controller splits a to-be-displayed image into at least two sub images in a non SPR pixel format, and sends the at least two sub images to the at least two display drive circuits includes:

the host controller splits the to-be-displayed image into a first sub image and a second sub image in the non SPR pixel format, sends the first sub image to the first display drive circuit, and sends the second sub image to the second display drive circuit, where the first sub image and the second sub image include at least one column of overlapping image pixels; and that each of the at least two display drive circuits receives one of the at least two sub images from the host controller, and drives, based on pixel data of the sub image in the non SPR pixel format, the display screen to display a part of the to-be-displayed image in an SPR manner includes:

the first display drive circuit drives, based on pixel data of the first sub image in the non SPR pixel format, the display screen to display a part of the to-be-displayed image in the SPR manner; and the second display drive circuit drives, based on pixel data of the second sub image in the non SPR pixel format, the display screen to display another part of the to-be-displayed image in the SPR manner.

With reference to the third aspect, in some implementations of the third aspect, that the first sub image and the second sub image include at least one column of overlapping image pixels includes: a column range of image pixels included in the first sub image is $[1, M+N_1]$, and a column range of image pixels included in the second sub image is $[M-N_2, Z]$, where Z is a total quantity of columns of image pixels included in the to-be-displayed image, Z, M, $N_1$, and $N_2$ are all positive integers, $1<M<Z$, and $Z>1$.

With reference to the third aspect, in some implementations of the third aspect, $N_1=N_2$.

According to a fourth aspect, this application provides a method for displaying an image in a multi display drive circuit system, where the multi display drive circuit system includes a host controller, a display screen, and at least two display drive circuits, and the method includes the following steps: The host controller generates at least two sub images in an SPR pixel format based on pixel data of a to-be-displayed image in a non SPR pixel format, and sends the at least two sub images to the at least two display drive circuits; and each of the at least two display drive circuits receives one of the at least two sub images from the host controller, and drives the display screen to display a part of the to-be-displayed image in an SPR manner, where the at least two display drive circuits drive each part displayed on the display screen to jointly present the to-be-displayed image.

It should be understood that the method for displaying an image in a multi display drive circuit system in the fourth aspect and the electronic device in the second aspect are based on a same inventive concept. Therefore, for beneficial technical effects that can be achieved by the technical solution in the fourth aspect, refer to the description in the second aspect. Details are not described again.

With reference to the fourth aspect, in some implementations of the fourth aspect, the multi display drive circuit system includes a first display drive circuit and a second display drive circuit, where the host controller generates a third sub image and a fourth sub image in the SPR pixel format based on the pixel data of the to-be-displayed image in the non SPR pixel format, sends the third sub image to the first display drive circuit, and sends the fourth sub image to the second display drive circuit; the first display drive circuit drives, based on pixel data of the third sub image in the SPR pixel format, the display screen to display the third sub image in the SPR manner: and the second display drive circuit drives, based on pixel data of the fourth sub image in the SPR pixel format, the display screen to display the fourth sub image in the SPR manner.

According to a fifth aspect, this application provides a circuit system, including one or more processors. The one or more processors are configured to read and execute a computer program stored in a memory, to perform the method according to any one of the third aspect or the possible implementations of the third aspect, or perform the method according to any one of the fourth aspect or the possible implementations of the fourth aspect.

Optionally, the memory may be located outside the circuit system or integrated into the circuit system.

Optionally, there may be one or more memories.

Further optionally, the circuit system further includes one or more communications interfaces.

According to a sixth aspect, this application provides a computer-readable storage medium, where the computer-readable storage medium stores a computer instruction, and when the computer instruction is run on a computer, the computer is enabled to perform the method according to any one of the third aspect or the possible implementations of the third aspect, or perform the method according to any one of the fourth aspect or the possible implementations of the fourth aspect.

According to a seventh aspect, this application provides a computer program product, where the computer program product includes computer program code, and when the computer program code is run on a computer, the computer is enabled to perform the method according to any one of the third aspect or the possible implementations of the third aspect, or perform the method according to any one of the fourth aspect or the possible implementations of the fourth aspect.

DESCRIPTION OF EMBODIMENTS

The following describes technical solutions of this application with reference to accompanying drawings.

For ease of understanding the technical solutions, some concepts and technologies used in this application are first briefly described.

In this application, an "image pixel" is a pixel in a to-be-displayed image, that is, an image point expressed by using a specific value. A "screen pixel" is a physical display unit for displaying an image pixel on a display screen. Conventionally, one image pixel corresponds to one screen pixel. Conventionally, an image pixel includes three color components: red, green, and blue. Each color component uses a numerical value to represent a color level or grayscale value of the color. In common 24-bit color displaying, each color component is represented by 8 bits, corresponding to a decimal number of 0 to 255. The image pixel may also include other components, such as a gamma component. The image pixel may alternatively include more than three color components. For example, two green components or two blue components are used, or a yellow component is introduced.

When the display screen displays the image, the to-be-displayed image is sent by a host controller to a display drive circuit, and the display drive circuit converts pixel data in the to-be-displayed image into a voltage signal or a current signal for controlling screen pixel brightness, and sends the voltage signal or current signal to the display screen, to control the display screen to display the image. Herein, the host controller may be one or more processors, and may be specifically a main chip of a mobile phone, that is, a system-on-chip (system on chip, SoC) for example, Qualcomm Snapdragon series chips or Huawei HiSilicon Semiconductor Kirin series chips. The display drive circuit may be specifically a display driver integrated circuit (display driver integrated circuit, DDIC), for example, CD40110BE from Texas Instruments or MM5450YV from Microchip (Microchip).

Figure 1:
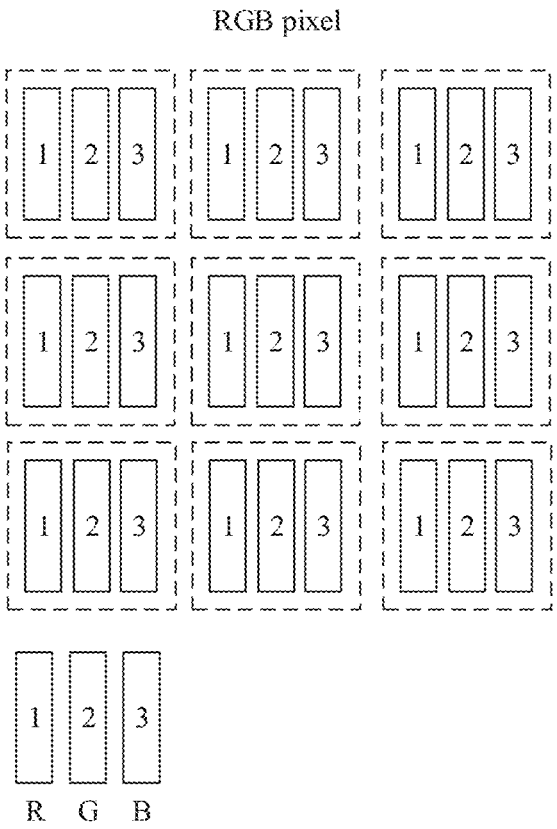
FIG. 1 is a schematic diagram of an RGB pixel.

FIG. 1 is a schematic diagram of a conventional screen pixel on a display screen. The conventional screen pixel generally includes three sub pixels: red, green, and blue, and is referred to as a red green blue (red green blue, RGB) pixel. In a conventional technology, each sub pixel displays a color component of a corresponding image pixel, and the three sub pixels jointly present a color of the image pixel. In the conventional technology, one screen pixel may also include more sub pixels. For example, on some display screens, in addition to red, green, and blue, a white sub pixel is added to one screen pixel. A screen pixel in this form is referred to as a red, green, blue, white (red green, blue, white, RGBW) pixel Because a special white sub pixel is set, the RGBW pixel can display a purer white color. On other display screens, a screen pixel includes a red sub pixel, a grass green sub pixel, an emerald sub pixel, and a blue sub pixel, and is referred to as a red green green blue (red green green blue, RGGB) pixel. Because human eyes are most sensitive to green light, richer colors can be presented by setting two green sub pixels.

A color component of an image pixel is converted into a light transmittance (for an LCD screen) or luminosity (for a light emitting diode (light emitting diode, LED) screen) of a corresponding sub pixel on the screen through a main chip and/or a display drive circuit for displaying.

Compared with a conventional display technology, in a sub pixel rendering (sub pixel rendering, SPR) technology, each pixel generally includes two sub pixels, usually arranged periodically in an order of "red+green" "green+blue", or "blue+red". The pixel including two sub pixels is referred to as an SPR pixel. Arrangement manners of SPR pixels may be different based on different designs.

Figure 2:
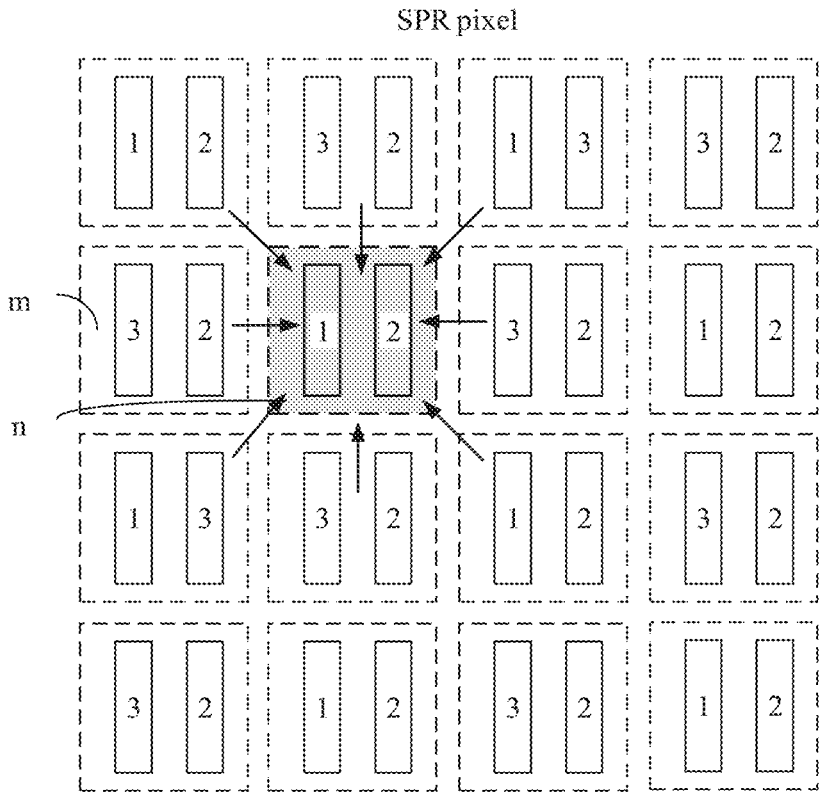
FIG. 2 is an example of an arrangement manner of an SPR pixel.

FIG. 2 is an example of an arrangement manner of an SPR, pixel. FIG. 2 shows three rows and four columns of SPR pixels, where each SPR pixel includes two sub pixels. Arrangement manners of SPR pixels in a second column and a fourth column are the same. An arrangement manner of sub pixels in a first sub pixel column in a first column of SPR pixels is the same as an arrangement manner of sub pixels in a first sub pixel column in a third column of SPR pixels, but an arrangement manner of sub pixels in a second sub pixel column in the first column is different from an arrangement manner of sub pixels in a second sub pixel column in the third column.

A basic principle of the SPR technology is to compute pixel data of a target pixel by using pixel data of a nearby pixel for reference. In other words, a value of each sub pixel of the target pixel is obtained through computation based on a value of a sub pixel of the nearby pixel. A value of each sub pixel of a pixel is also referred to as pixel data of the pixel. Because each screen pixel has a missing color in the SPR technology, the color needs to be displayed by using a nearby screen pixel.

Assuming that a gray-filled SPR pixel shown in FIG. 2 is a target pixel, pixel data of the target pixel may be obtained through computation with reference to pixel data of an adjacent pixel of the target pixel. For example, the pixel data of the target pixel is computed by using upper, lower, left, and right pixels and four diagonal pixels thereof for reference. For another example, the pixel data of the target pixel is computed by using upper, lower, left, and right pixels thereof for reference. Specifically, one color component in a plurality of adjacent image pixels of the target pixel may be averaged to obtain pixel data of corresponding sub pixels on the display screen. For example, for screen pixels m and n in FIGS. 2, 1, 2, and 3 in the figure represent three sub pixels: red, green, and blue. It can be seen that a red sub pixel is missing in m. Therefore, display data of a red sub pixel in the nearby pixel n may be obtained by averaging red components of image pixels corresponding to m and n. In this way, a mapping between an original RGB image and an SPR image actually displayed on the screen can be implemented. Certainly, this is merely a simple example, and the current SPR algorithm is much more complex than this, but the basic principle is the same. A plurality of SPR algorithms are available, and are not limited in the embodiments of this application.

A person skilled in the art may understand that in the SPR technology, a quantity of sub pixels on the display screen is less than a quantity of color components of image pixels of a to-be-displayed image in a non SPR pixel format (for example, an RGB format). For example, for an RGB image with a resolution of 1920×1080, a quantity of color components of image pixels is 1920×1080×3, but a quantity of corresponding sub pixels on a display screen with a resolution of 1920×1080 may be only 1920×1080×2. When displaying is performed on the display screen with a resolution lower than a maximum resolution of the display screen, several actual sub pixels may be combined into one virtual sub pixel for displaying. For example, several actual sub pixels of a same color in a same column or on a same diagonal are displayed as a whole (which may be referred to as a virtual sub pixel). In this case, it should be understood that a quantity of virtual sub pixels is less than the quantity of color components of image pixels. For example, if an image with a resolution of 1024×768 is displayed on a display screen with a maximum resolution of 1920×1080, a quantity of virtual sub pixels may be only 1024×768×2, which is less than a quantity 1024×768×3 of color components of image pixels.

Flexible display screens have been widely applied to terminal products such as mobile phones over recent years thanks to their advantages such as being thin and light, non-breakable, foldable, and rollable. However, existing flexible display screens are seldom used in foldable and rollable terminal products, and are referred to as foldable terminal devices.

When a foldable terminal device displays an image, because a flexible display screen can be flexibly folded, a multi display drive circuit system is generally considered for use. A multi display drive circuit system generally includes a host controller, at least two display drive circuits, and a display screen. The at least two display drive circuits jointly drive the display screen to display the image.

Figure 3:
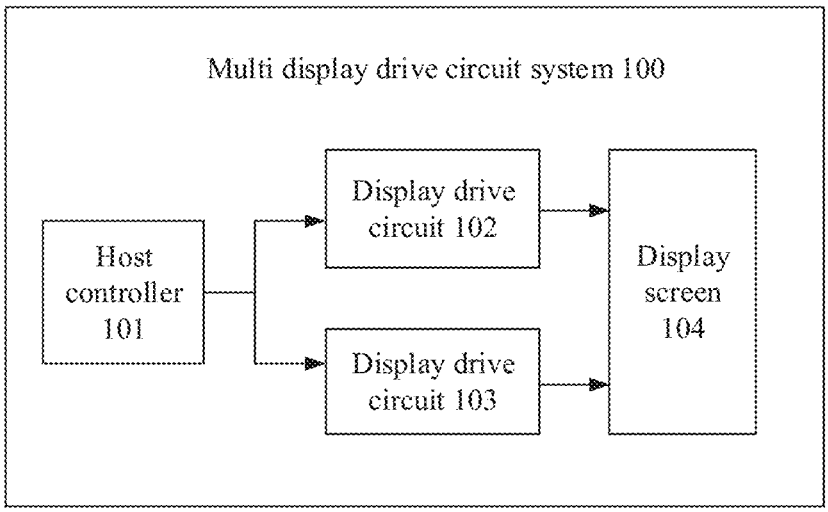
FIG. 3 is a schematic block diagram of a dual display drive circuit system 100.
Figure 4:
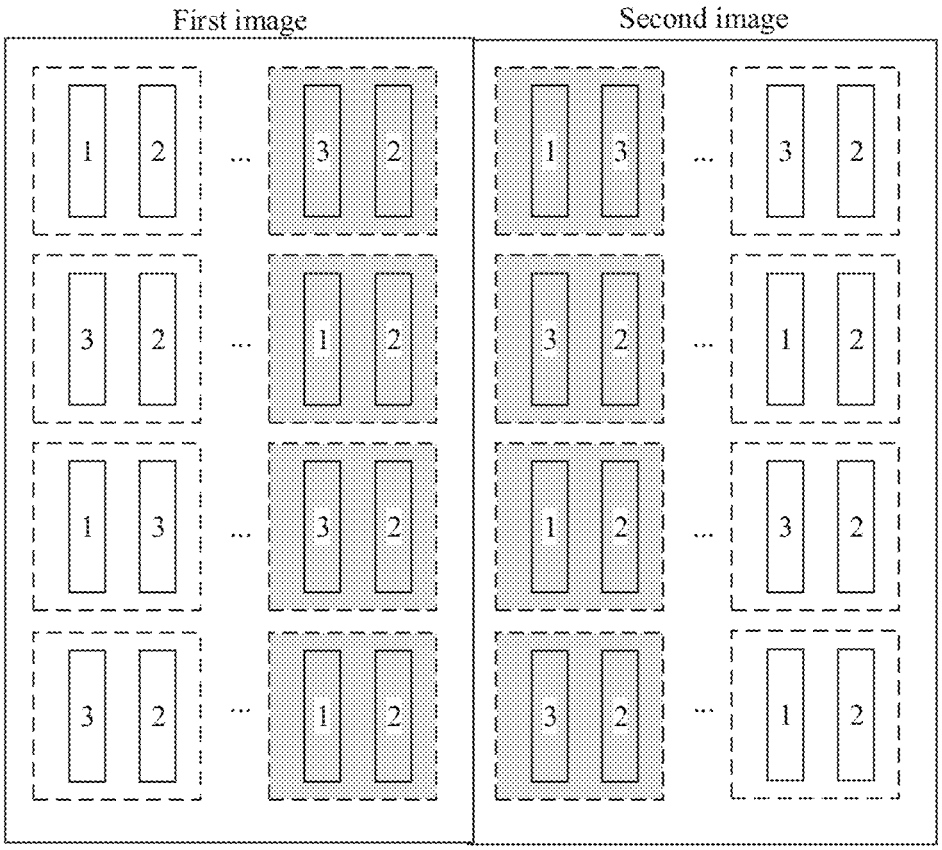
FIG. 4 is a schematic diagram of pixel data that needs to be shared between a first image and a second image.

However, based on the basic principle of the SPR technology, when an image is displayed by using multiple display drive circuits, pixel data needs to be shared between the display drive circuits. With reference to FIG. 3 and FIG. 4, the following uses a dual drive display circuit system as an example for description.

FIG. 3 is a schematic diagram of a dual drive display circuit system 100. As shown in FIG. 3, the system 100 includes a host controller 101, a display drive circuit 102, a display drive circuit 103, and a display screen 104. The host controller splits a to-be-displayed image into two, to obtain a first image and a second image. Then the host controller sends the first image and the second image to the display drive circuit 102 and the display drive circuit 103 respectively, and the display drive circuit 102 and the display drive circuit 103 drive the display screen to display the first image and the second image, to present the to-be-displayed image on the display screen.

Based on the basic principle of the SPR technology described above, pixel data needs to be shared between the display drive circuit 102 and the display drive circuit 103 to meet requirements of the SPR algorithm. The following describes a reason with reference to FIG. 4.

FIG. 4 is a schematic diagram of pixel data that needs to be shared between a first image and a second image. It should be understood that in a multi display drive circuit system, each display drive circuit drives a display screen to display a part of a to-be-displayed image. Based on the system 100 shown in FIG. 3, it is assumed that the display drive circuit 102 in FIG. 3 is configured to drive the display screen to display a part of the to-be-displayed image (hereinafter referred to as the first image), and the display drive circuit 103 is configured to drive the display screen to display another part of the to-be-displayed image (hereinafter referred to as the second image).

As shown in FIG. 4, to display the first image, the display drive circuit 102 needs to compute pixel data of all SPR pixels of the first image, or needs to compute values of sub pixels of each SPR pixel included in the first image. It is clear that all the SPR pixels of the first image include SPR pixels in a rightmost column of the first image (such as pixels of filled parts in FIG. 4). For computation of pixel data of the SPR pixels in the rightmost column, reference needs to be made to values of sub pixels of right SPR pixels thereof in addition to values of sub pixels of upper, lower, and left SPR pixels thereof. However, the right pixels are located in the second image and are sent to the display drive circuit 103 by the host controller 101.

Likewise, to display the second image, the display drive circuit 103 needs to compute pixel data of all SPR pixels included in the second image, including pixel data of SPR pixels in a leftmost column of the second image. The pixel data of the SPR pixels in the leftmost column of the second image is obtained through computation with reference to pixel data of upper, lower, and right SPR pixels thereof, and pixel data of left SPR pixels thereof. Similarly, the SPR pixels in the leftmost column are located in the first image and are sent to the display drive circuit 102 by the host controller 101.

It can be learned that the display drive circuit 102 and the display drive circuit 103 can complete, only when pixel data required by each other is shared between the display drive circuit 102 and the display drive circuit 103, pixel rendering by using the SPR technology, and respectively display the first image and the second image, thereby displaying the to-be-displayed image.

Figure 5:
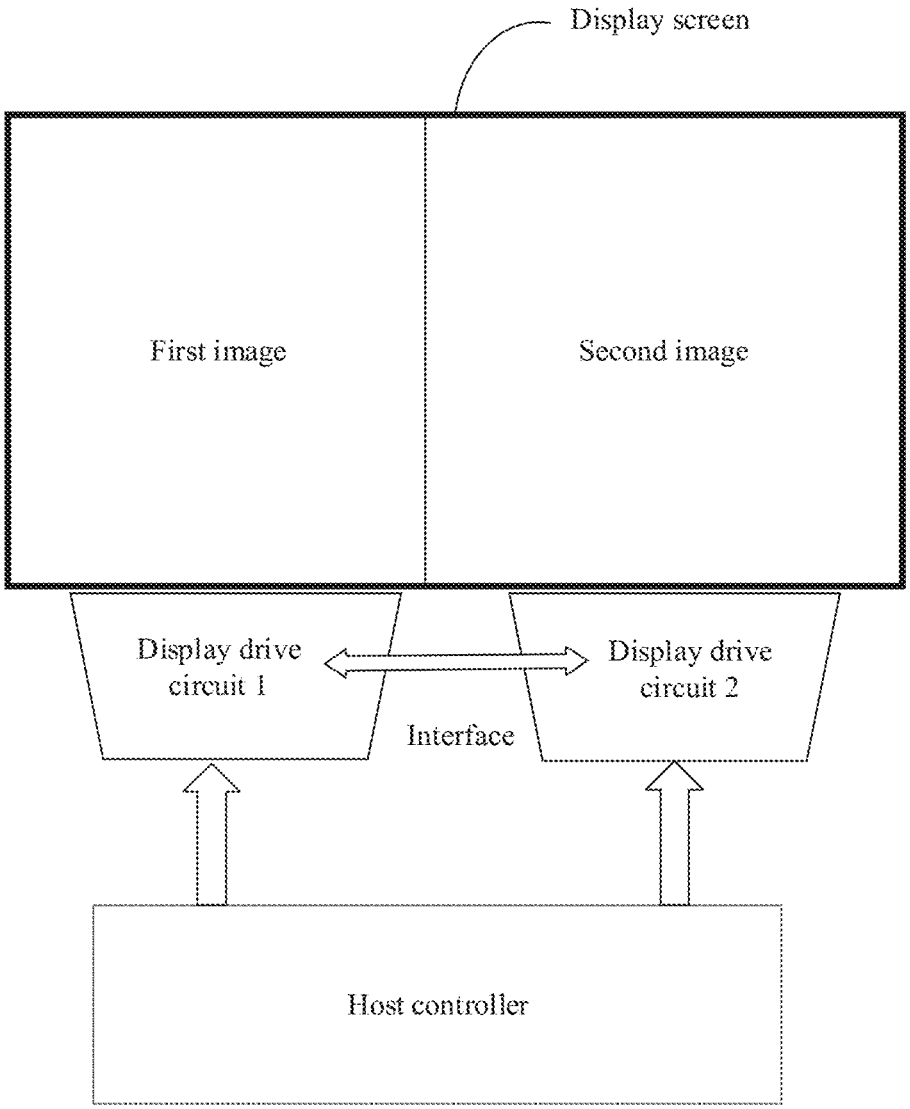
FIG. 5 is a schematic diagram for sharing pixel data between two display drive circuits.

Therefore, in an existing technical solution, it is proposed that an interface (or a data channel) used for pixel data transmission should be established between two display drive circuits of the system 100, to implement pixel data sharing, as shown in FIG. 5.

FIG. 5 is a schematic diagram for sharing pixel data between two display drive circuits. An interface (interface) for sharing pixel data is established between two display drive circuits (a display drive circuit 1 and a display drive circuit 2 shown in FIG. 5), and each display drive circuit may share, with the other display drive circuit through the interface, pixel data required by the other display drive circuit.

The structure shown in FIG. 5 resolves the problem of pixel data sharing, but brings about other problems. For example, to establish an interface between two display drive circuits, an area of a display drive circuit needs to be larger, so that an area for establishing the interface is reserved on each display drive circuit; and this causes a flexible printed circuit (flexible printed circuit, FPC) area of the display drive to increase. In addition, because a physical distance between the display drive circuit 1 and the display drive circuit 2 is relatively short, signal transmission on each display drive circuit causes interference to the other display drive circuit through the interface, and therefore inevitably causes problems of EMI and ESD.

Based on the foregoing status quo of displaying an image in a multi display drive circuit system, this application provides an electronic device having a multi display drive circuit system and a method for displaying an image by using the multi display drive circuit system, to avoid problems such as FPC area increase, EMI, and EMD of a display screen.

The following describes the technical solutions of this application in detail.

Figure 6:
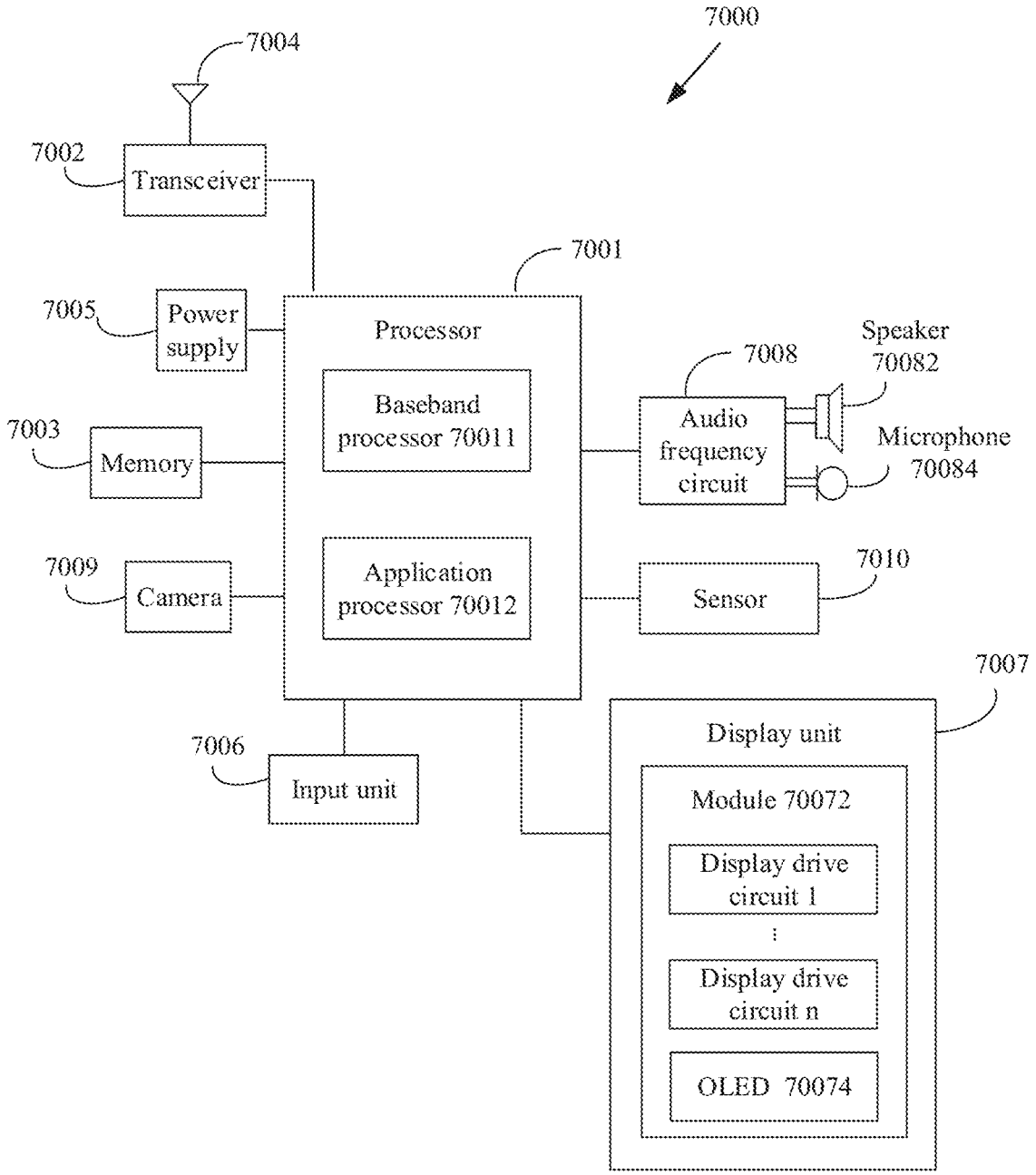
FIG. 6 is a schematic structural diagram of an electronic device 7000 according to this application.

FIG. 6 is a schematic structural diagram of an electronic device 7000 according to this application. As shown in FIG. 6, the electronic device 7000 includes one or more processors 7001 and one or more transceivers 7002.

Optionally, the electronic device 7000 further includes one or more memories 7003. The processor 7001, the transceiver 7002, and the memory 7003 may communicate with each other by using an internal connection path, and transfer a control signal and/or a data signal. The memory 7003 is configured to store a computer program, and the processor 7001 is configured to invoke and run the computer program in the memory 7003, so that the electronic device performs an image display method provided in this application.

The processor 7001 may include a baseband processor 70071 and an application processor 70072.

Optionally, the processor 7001 may further include a graphics processing unit (graphics processing unit, GPU), an image signal processor (image signal processor, ISP), a display subsystem (display subsystem, DSS), a neural network processing unit (neural network processing unit, NPU), and the like. Optionally, the foregoing processing units may be integrated on one chip, to form a system-on-chip (system on chip, SoC).

Optionally, the electronic device 7000 may further include an antenna 7004. The transceiver 7002 sends or receives a signal by using the antenna 7004.

Optionally, the processor 7001 and the memory 7003 may be combined into one processing apparatus, and the processor 7001 is configured to execute program code stored in the memory 7003 to implement a corresponding function. In specific implementation, the memory 7003 may also be integrated in the processor 7001, that is, it is an on-chip memory. Alternatively, the memory 7003 is independent of the processor 7001, and is located outside the processor 7001, that is, it is an off-chip memory.

In addition, to improve functions of the terminal device, the terminal device 7000 may further include one or more of an input unit 7006, a display unit 7007, an audio circuit 7008, a camera 7009, a sensor 7010, and the like. The audio circuit may further include a speaker 70082, a microphone 70084, and the like.

The input unit 7006 is a signal input interface, and the display unit 7007 is a signal output interface, for example, a display screen, A signal output by the display unit 7007 may include an audio, a video, an image, or the like.

In this application, the display unit 7007 may be an AMOLED, and the AMOLED includes a module 70072. The module 70072 may be provided with multiple display drive circuits, such as a display drive circuit 1, . . . , and display drive circuit n shown in FIG. 6, where n≥2. In addition, the module 70072 further includes an OLED 70074.

In addition, the AMOLED may be a flexible display screen. That is, the electronic device 7000 may be a foldable electronic device.

The technical solutions of this application may be applied to the foldable electronic device shown in FIG. 6, and an image is displayed by using a multi display drive circuit system. Details are described hereinafter.

In the following embodiments, a host controller may be one or more processors, and may be specifically a system-on-chip (system on chip, SoC).

In some embodiments provided in this application, the host controller of the electronic device generates at least two sub images in a non SPR pixel format (for example, an RGB format), and sends the at least two sub images to the display drive circuits, and then the display drive circuits drive, by using an SPR algorithm, the display screen to display the image.

Specifically, the host controller splits a to-be-displayed image into at least two sub images in the non SPR pixel format, and sends the at least two sub images to the at least two display drive circuits, Each sub image and an adjacent sub image include at least one column of overlapping image pixels.

It should be understood that the at least one column of overlapping image pixels is one or more columns of image pixels at a boundary between each sub image and the adjacent sub image thereof.

For example, it is assumed that the to-be-displayed image is horizontally split into a plurality of sub images. Except two sub images located in edge positions, each sub image includes at least image pixels in a rightmost column of a left adjacent sub image and image pixels in a leftmost column of a right adjacent sub image.

A sub image in a left edge position includes at least image pixels in a leftmost column of a right adjacent sub image. A sub image in a right edge position includes at least image pixels in a rightmost column of a left adjacent sub image.

In addition, for a pixel array, rows and columns are relative concepts. A person skilled in the art should understand that a "column" of a pixel array may alternatively be described as a "row". This change should not cause a limitation on the technical solutions of this application. The following descriptions are all based on the "column".

Each of the at least two display drive circuits receives one of the at least two sub images from the host controller, and drives, based on pixel data of the sub image in the non SPR pixel format, the display screen to display a part of the to-be-displayed image in an SPR manner. The at least two display drive circuits drive each part displayed on the display screen to present the to-be-displayed image.

A part that each display drive circuit drives the display screen to display corresponds to a sub image received by the display drive circuit from the host controller. In other words, each display drive circuit receives a sub image from the host controller, and drives, based on pixel data of image pixels included in the sub image, the display screen to display the sub image in the SPR manner, thereby presenting a part of the to-be-displayed image. The at least two display drive circuits respectively drive the display screen to display (or present) a part of the to-be-displayed image, and the plurality of parts jointly present the to-be-displayed image.

It should be understood that the display screen displays the sub image in the SPR manner, that is, the display screen displays the sub image by using the SPR technology.

Optionally, in an implementation, the host controller may split the to-be-displayed image into at least two sub images based on a quantity of display drive circuits, and send one of the at least two sub images to each display drive circuit. Correspondingly, each display drive circuit receives a sub image from the host controller and controls the display screen to display a part of the to-be-displayed image.

Alternatively, in another implementation, the host controller splits the to-be-displayed image into at least two sub images, sends more than one sub image to some of the at least two display drive circuits, and sends one sub image to each of other display drive circuits. Correspondingly, the display drive circuit that receives more than one sub image may drive the display screen to display a plurality of parts of the to-be-displayed image. Each of the display drive circuits that receives one sub image may drive the display screen to display a part of the to-be-displayed image. Therefore, all parts displayed on the display screen jointly present the to-be-displayed image.

Figure 7:
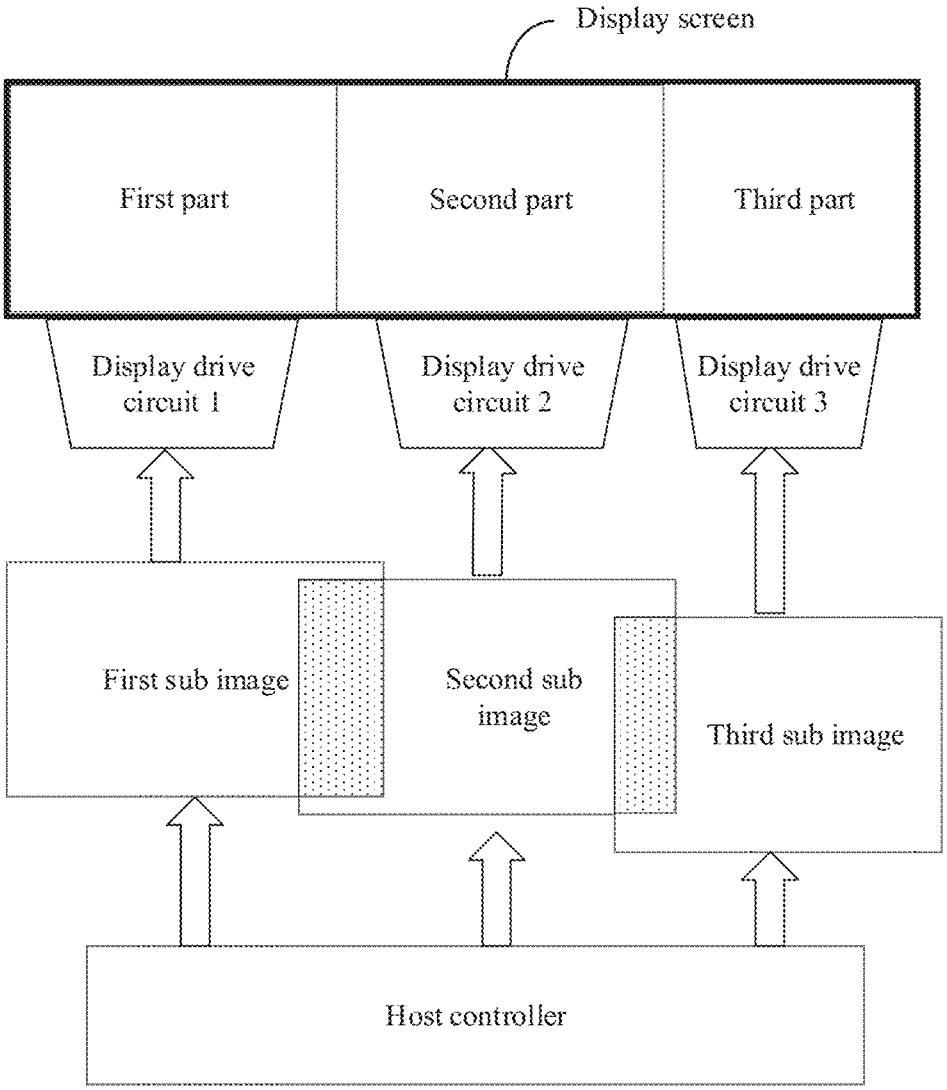
FIG. 7 is an example of a method for displaying an image in a multi display drive system according to this application.

The following provides descriptions with reference to FIG. 7.

FIG. 7 is an example of a method for displaying an image in a multi display drive circuit system according to this application. In FIG. 7, an example in which the multi display drive circuit system includes three display drive circuits is used for description. Certainly, the multi display drive circuit system may include other quantities of display drive circuits.

As shown in FIG. 7, a host controller splits a to-be-displayed image into three sub images, which are a first sub image, a second sub image, and a third sub image, and sends the three sub images to the three display drive circuits respectively. The first sub image and the adjacent second sub image have overlapping image pixels. The second sub image and the adjacent first sub image and the adjacent third sub image all have overlapping image pixels. Specifically, every two adjacent sub images include at least one column of overlapping image pixels.

As described above, the at least one column of overlapping image pixels included in every two adjacent sub images should be one or more columns of image pixels in a boundary part between the two adjacent sub images.

As shown in FIG. 7, the first sub image should include at least image pixels in a leftmost column of the second sub pixel. The second sub image should include at least image pixels in a rightmost column of the first sub image. In addition, the second sub pixel should include at least image pixels in a leftmost column of the third sub image. The third sub image should include at least image pixels in a rightmost column of the second sub image.

A display drive circuit 1 receives the first sub image from the host controller. The display drive circuit 1 computes, based on pixel data of the first sub image in a non SPR pixel format, pixel data in an SPR pixel format required for displaying a first part of the to-be-displayed image on a display screen, and drives the display screen to display the first part.

It should be understood that, for a principle of computing pixel data of an SPR pixel by the display drive circuit 1, refer to the basic principle of the SPR algorithm described above, as described in FIG. 2. Details are not described herein again.

Similarly, a display drive circuit 2 receives the second sub image from the host controller. The display drive circuit 2 computes, based on pixel data of the second sub image in the non SPR pixel format, pixel data in the SPR pixel format required for displaying a second part of the to-be-displayed image on the display screen, and drives the display screen to display the second part.

A display drive circuit 3 receives the third sub image from the host controller. The display drive circuit 3 computes, based on pixel data of the third sub image in the non SPR pixel format, pixel data in the SPR pixel format required for displaying a third part of the to-be-displayed image on the display screen, and drives the display screen to display the third part.

It should be understood that the display drive circuit 1, the display drive circuit 2, and the display drive circuit 3 respectively drive the display screen to display a part of the to-be-displayed image, to present a complete to-be-displayed image on the display screen.

In these embodiments, because the host controller splits the to-be-displayed image into a plurality of sub images having overlapping image pixels, each display drive circuit obtains, after each sub image is sent to the display drive circuit, more image pixels than image pixels of the image part to be displayed. Therefore, image pixels at an edge of the image part to be displayed are known to each display drive circuit. Therefore, there is no need to share pixel data between the display drive circuits, and SPR pixel data of each part of the to-be-displayed image can be computed to drive the display screen to display the image part.

In addition, it should be understood that a quantity of columns of pixels included in the first sub image is greater than a quantity of columns of pixels included in the first part. A quantity of columns of pixels included in the second sub image is greater than a quantity of columns of pixels included in the second part. A quantity of columns of pixels included in the third sub image is greater than a quantity of columns of pixels included in the third part.

In other words, image pixels of the sub image obtained by each display drive circuit are more than image pixels of the part displayed on the display screen driven by the display drive circuit, and the excess is the "overlapping image pixels" described in this application.

Figure 8:
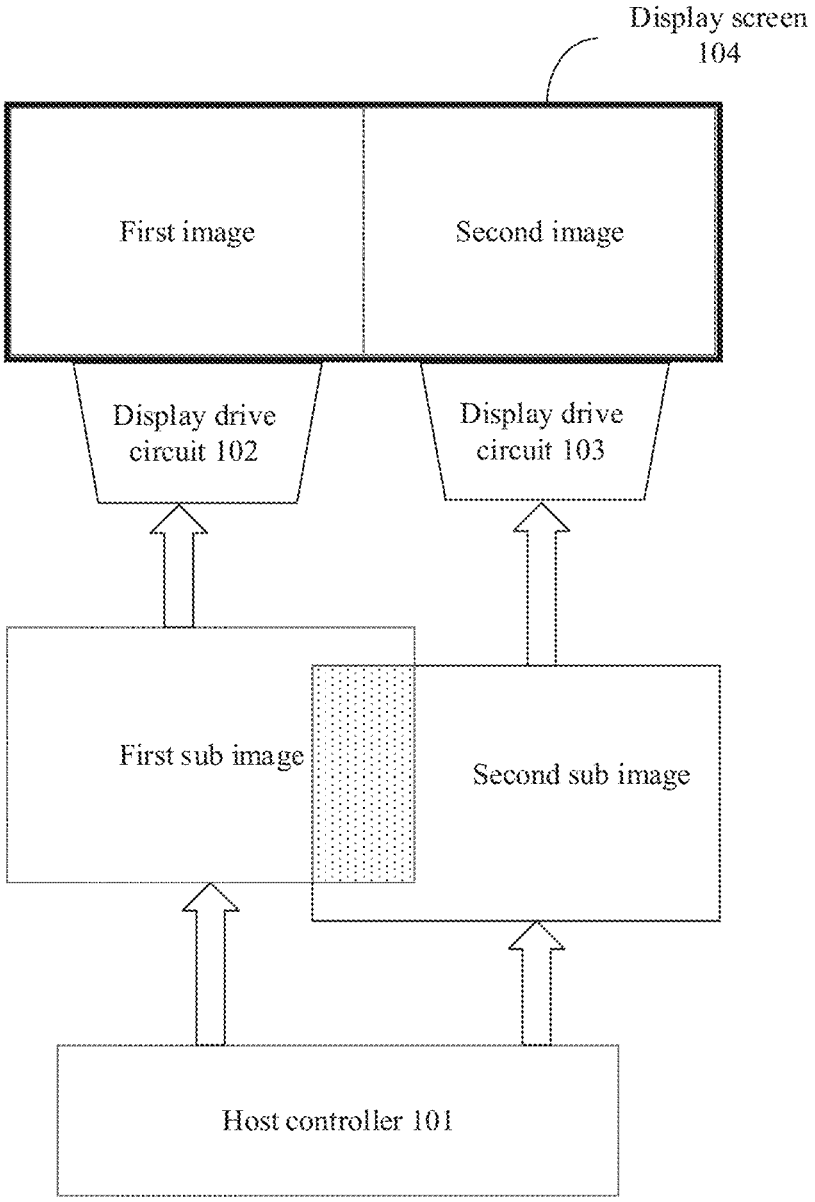
FIG. 8 is a schematic diagram of a method for displaying an image in a dual display drive circuit system.

With reference to FIG. 8, the following describes an application of an image display method provided in this application to a dual display drive circuit system.

FIG. 8 is a schematic diagram of a method for displaying an image in a dual display drive circuit system.

In the dual display drive circuit system, a host controller splits a to-be-displayed image into a first sub image and a second sub image in a non SPR pixel format, where the first sub image and the second sub image include at least one column of overlapping image pixels.

The host controller sends the first sub image to a first display drive circuit in the dual display drive circuit system, and sends the second sub image to a second display drive circuit.

The first display drive circuit receives the first sub image from the host controller, and drives, based on pixel data of the first sub image in the non SPR pixel format, a display screen to display a part of the to-be-displayed image in an SPR manner.

In addition, the second display drive circuit receives the second sub image from the host controller, and drives, based on pixel data of the second sub image in the non SPR pixel format, the display screen to display another part of the to-be-displayed image in the SPR manner.

In FIG. 8, the part that the first display drive circuit drives the display screen to display is referred to as a first image, and the another part that the second display drive circuit drives the display screen to display is referred to as a second image.

Optionally, the non SPR pixel format may be an RGB pixel format.

Specifically, the host controller splits the to-be-displayed image into a plurality of sub images, and sends the sub images to multiple display drive circuits respectively. It is assumed that the multiple display drive circuits drive the display screen to display a plurality of parts of the to-be-displayed image, and column ranges of pixels included in the plurality of parts are as follows:

$[1, L_1], [L_1+1, L_2], \ldots, [L_n, Z]$, where $L_1, L_2, \ldots$, and $L_n$, are all positive integers.

In this case, column ranges of pixels included in the plurality of sub images may be as follows:

$[1, L_1+P_1], [L_1+1-P_2, L_2+P_3], \ldots, [L_n-P_n, Z]$, where $P_1$, $P_2$, $P_3$, and $P_n$ are all positive integers.

Using the first sub image and the second sub image as an example, column ranges of image pixels included in the first sub image and the second sub image may be computed in the following manner:

A column range of image pixels included in the first sub image is $[1, M+N_1]$, and a column range of image pixels included in the second sub image is $[M-N_2, Z]$, where Z is a total quantity of columns of image pixels included in the to-be-displayed image, Z, M, $N_1$, and $N_2$ are all positive integers, $1<M<Z$, and $Z>1$.

It should be understood that M may be any column between a first column and a $Z^{th}$ column.

For example, assuming that the to-be-displayed image includes 100 columns of image pixels in total (that is, $Z=100$), where $N_1=N_2=1$ and $M=50$, the first sub image output by the host controller includes image pixels in the first column to a $51^{st}$ column, that is, the column range of image pixels included in the first sub image is [1, 51]. The second sub image includes image pixels in a $49^{th}$ column to a $100^{th}$ b column, that is, the column range of image pixels included in the second sub image is [49, 100].

The first display drive circuit drives, based on the pixel data of the first sub image in the non SPR pixel format, the display screen to display a part of the to-be-displayed image in the SPR manner. Specifically, the first display drive circuit drives, based on the image pixels in the first column to the $51^{st}$ column received from the host controller, the display screen to display an image part corresponding to the image pixels in the first column to the $50^{th}$ column of the to-be-displayed image.

In addition, the second display drive circuit drives, based on the pixel data of the second sub image in the non SPR pixel format, the display screen to display another part of the to-be-displayed image in the SPR manner Specifically, the second display drive circuit drives, based on the image pixels in the $49^{th}$ column to the $100^{th}$ column received from the host controller, the display screen to display an image part corresponding to the image pixels in the $51^{th}$ column to the $100^{th}$ column of the to-be-displayed image.

It can be learned that the image part corresponding to the image pixels in the first column to the $50^{th}$ column of the to-be-displayed image and the image part corresponding to the image pixels in the $51^{st}$ column to the $100^{th}$ column of the to-be-displayed image are displayed on the display screen, and the to-be-displayed image is presented.

It should be understood that in this example, because M=Z/2 the first display drive circuit and the second display drive circuit respectively drive the display screen to display half of the to-be-displayed image.

It should be noted that in FIG. 7 and FIG. 8, adjacent sub images are displayed in a staggered manner for ease of showing overlapping parts. Actually, one or more columns of the boundary part between two adjacent sub images completely overlap.

Figure 9:
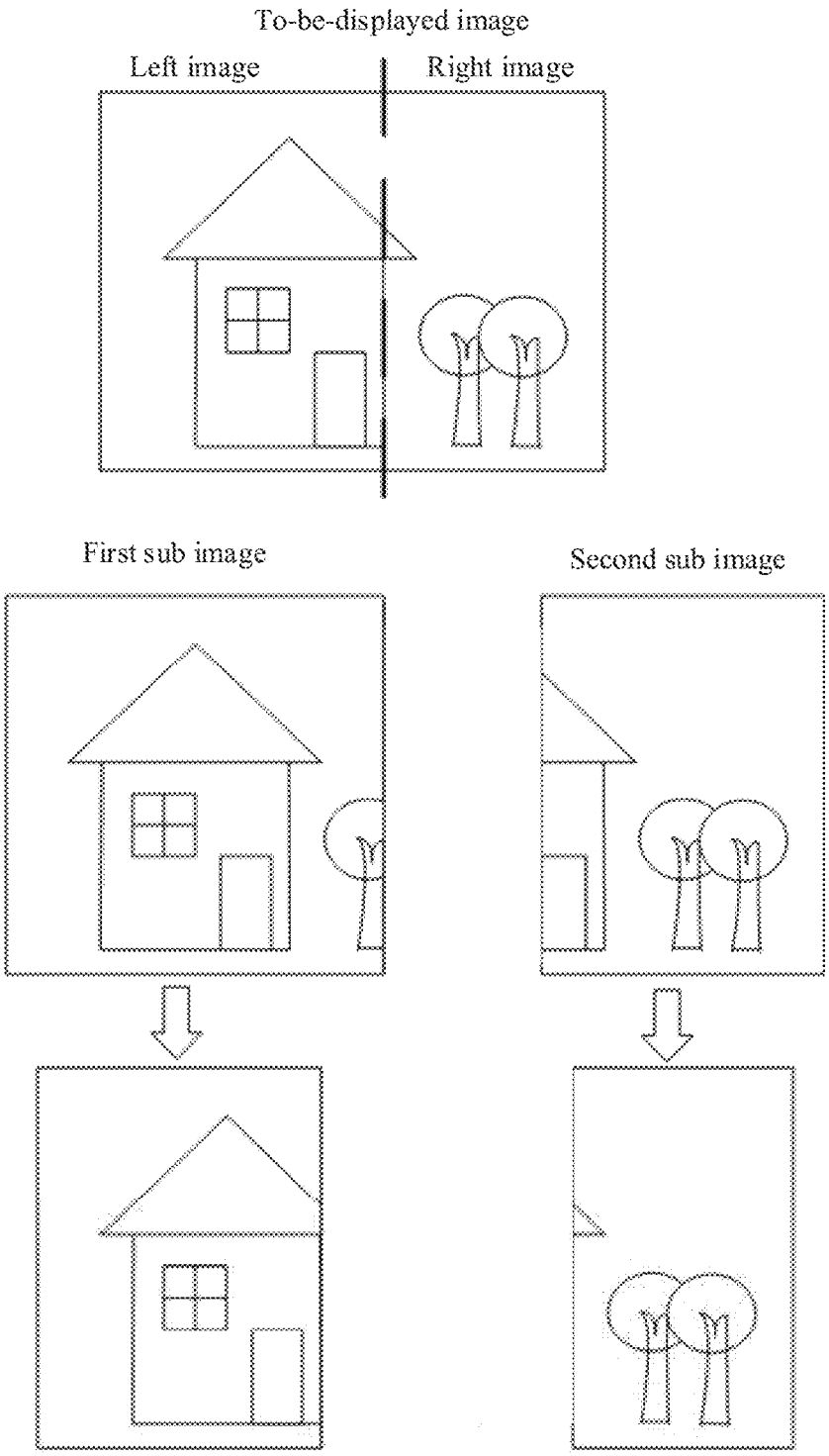
FIG. 9 is an example of an image display method according to this application.

FIG. 9 is an example of an image display method according to this application. As shown in FIG. 9, a dashed line shown on a to-be-displayed image represents a boundary line between parts that two display drive circuits respectively drive a display screen to display. For example, a first display drive circuit drives the display screen to display an image on the left of the dashed line, and the second display drive circuit drives the display screen to display an image on the right of the dashed line.

Using an architecture shown in FIG. 8 as an example, the host controller 101 splits the to-be-displayed image, and outputs the first sub image and the second sub image having overlapping image pixels. The overlapping image pixels are one or more columns of image pixels in a boundary part between the first sub image and the second sub image. The host controller 101 sends the first sub image to the display drive circuit 102, and sends the second sub image to the display drive circuit 103.

It can be learned that the display drive circuit 102 not only obtains all image pixels of the left image on the left of the dashed line, but also obtains image pixels near the boundary line, where the image pixels near the boundary line are mainly one or more columns of image pixels on the right of the boundary line. Likewise, the display drive circuit 103 also obtains all image pixels of the right image on the right of the dashed line and also obtains one or more columns of image pixels on the left of the boundary line.

Therefore, the display drive circuit 102 may compute pixel data of all pixels of the left image in an SPR pixel format based on all the obtained image pixels of the first sub image, thereby driving the display screen 104 to display the left image in the SPR manner. The display drive circuit 103 may compute pixel data of all pixels of the right image in the SPR pixel format based on all the obtained image pixels of the second sub image, thereby driving the display screen 104 to display the right image in the SPR manner.

It should be understood that the boundary line shown in FIG. 9 may be in a central position or a non-central position of the to-be-displayed image.

Optionally, in specific implementation, interaction may be performed between the host controller and the display drive circuit by using a display serial interface (display serial interface, DSI), or a communications interface other than a DSI may be used. This is not limited in this application.

In other embodiments provided in this application, the host controller generates at least two sub images in the SPR pixel format based on pixel data of the to-be-displayed image in the non sub pixel rendering SPR pixel format, and sends the at least two sub images to the at least two display drive circuits.

Each of the at least two display drive circuits receives one of the at least two sub images from the host controller, and drives the display screen to display the received sub image.

It should be understood that in the previously described embodiments, the sub images are in the non SPR pixel format (for example, the RGB format). However, in this embodiment, the host controller splits the to-be-displayed image into a plurality of sub images in the SPR pixel format based on an SPR algorithm. To be specific, the host controller completes image mapping from the original non SPR pixel format (for example, the RGB format) to the SPR pixel format. The image in the SPR pixel format directly provides display data of each sub pixel on the display screen, for example, a color level or grayscale value of each sub pixel. Therefore, the display drive circuit may directly drive the display screen to display the sub image received from the host controller. The foregoing operations may be implemented by using an application processor (application processor, AP), or may be implemented by using a graphics processing unit (graphics processing unit, GPU), or may be implemented by using a display subsystem (display subsystem DSS). This is not limited in this application. A person skilled in the art may understand that the foregoing circuit units may be discrete components, or may be integrated into a chip, for example, a system-on-chip (system on chip, SoC) of a mobile phone.

As described above, a quantity of sub pixels on the display screen is less than a quantity of color components of pixels in the to-be-displayed image in the non SPR pixel format. A person skilled in the art may understand that in the SPR technology, a quantity of sub pixels on the display screen is less than a quantity of color components of image pixels of the to-be-displayed image in the non SPR pixel format (for example, the RGB format). For example, for an RGB image with a resolution of 1920×1080, a quantity of color components of image pixels is 1920×1080×3, but a quantity of corresponding sub pixels on a display screen with a resolution of 1920×1080 may be only 1920×1080×2. Correspondingly, a quantity of sub pixels indicated by a union set of the sub images in the SPR pixel format is also less than the quantity of color components of image pixels of the to-be-displayed image.

Generally, the quantity of sub pixels indicated by the union set of the sub images in the SPR pixel format is equal to a quantity of sub pixels on the display screen. When displaying is performed on the display screen with a resolution lower than a maximum resolution of the display screen, several actual sub pixels are usually combined into one virtual sub pixel for displaying. For example, several actual sub pixels of a same color in a same column or on a same diagonal are displayed as a whole (which may be referred to as a virtual sub pixel). In this case, it should be understood that a quantity of virtual sub pixels is less than the quantity of color components of image pixels. For example, if an image with a resolution of 1024×768 is displayed on a display screen with a maximum resolution of 1920×1080, a quantity of virtual sub pixels may be only 1024×768×2, which is less than a quantity 1024×768×3 of color components of image pixels. In this case, the quantity of sub pixels indicated by the union set of the sub images in the SPR pixel format is equal to the quantity of virtual sub pixels.

A person skilled in the art may understand that when the host controller generates a sub image in the SPR pixel format, the host controller generally needs to know an arrangement manner of sub pixels on the display screen, and information about the arrangement manner may be written into a setting parameter of the host controller. For example, the information about the arrangement manner is written into a memory of the host controller or an external memory.

The following continues to use the two display drive circuits as an example for description.

The host controller generates a third sub image and a fourth sub image in the SPR pixel format based on the pixel data of the to-be-displayed image in the non SPR pixel format and the SPR algorithm.

The host controller sends the third sub image to the first display drive circuit, and sends the fourth sub image to the second display drive circuit.

The first display drive circuit drives, based on pixel data of the third sub image in the SPR pixel format, the display screen to display the third sub image in the SPR manner.

The second display drive circuit drives, based on pixel data of the fourth sub image in the SPR pixel format, the display screen to display the fourth sub image in the SPR manner.

To be specific, in this embodiment, the host controller renders the to-be-displayed image based on the SPR algorithm, and directly outputs the rendered image to the display drive circuit. Therefore each display drive circuit may directly drive the display screen to display the rendered sub image.

Herein, the rendered image is also an image in the SPR pixel format.

For example, an SPR algorithm module, a splitter, and a MIPI interface may be integrated on the host controller. The SPR algorithm module renders the to-be-displayed image based on the SPR algorithm, to obtain the rendered image. The SPR algorithm module outputs the rendered image to the splitter (splitter). The splitter splits the rendered image into two sub images, and then outputs the two sub images to the two display drive circuits respectively by using two mobile industry processor interface (mobile industry processor interface, MIPI) sending interfaces (denoted as MIPI Tx). Each display drive circuit drives the display screen to display the sub image received by the display drive circuit, to present the to-be-displayed image on the display screen.

Figure 10:
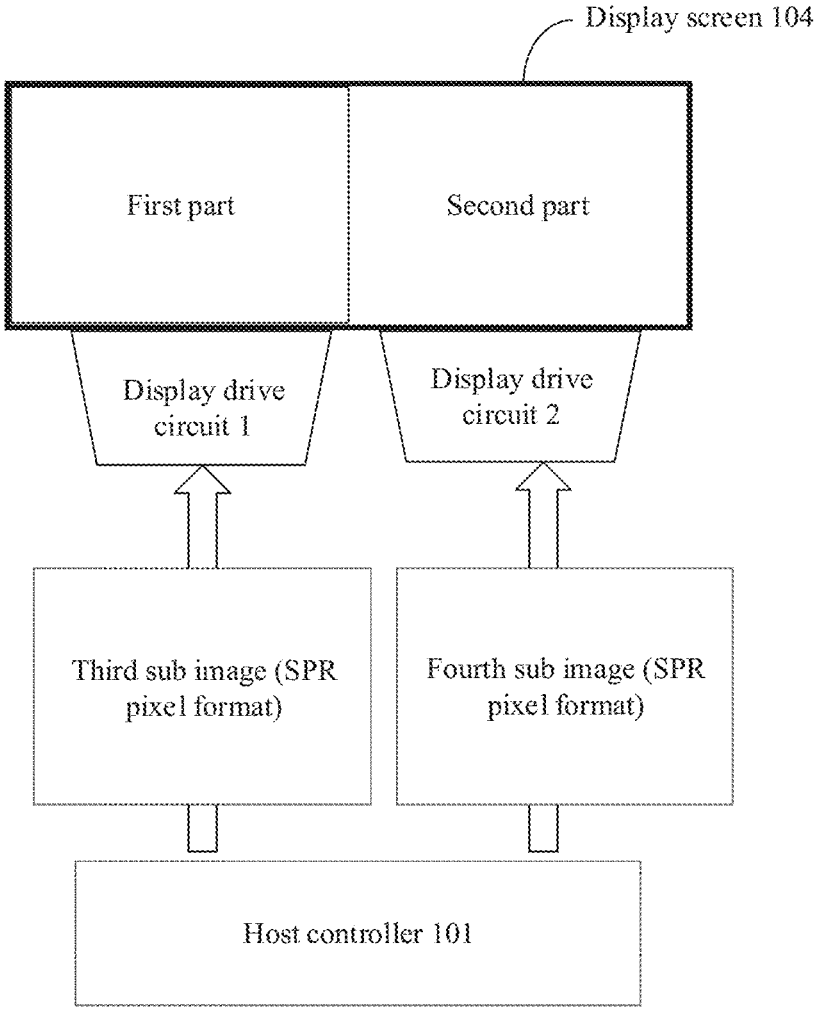
FIG. 10 is another schematic diagram of an image display method according to this application.

FIG. 10 is another schematic diagram of an image display method according to this application. As shown in FIG. 10, a host controller 101 outputs a rendered third sub image and a rendered fourth sub image respectively to a display drive circuit 102 and a display drive circuit 103. The display drive circuit 102 drives a display screen 104 to display a first SPR image in an SPR manner, and the display drive circuit 103 drives the display screen 104 to display a second SPR image in the SPR manner.

Herein, the SPR image represents an image in an SPR pixel format.

The method for displaying an image in a multi display drive circuit system according to this application is described in detail above. Compared with a conventional multi display drive circuit system, the multi display drive circuit system in this application avoids problems such as FPC area increase, EMI, and ESD caused by establishing a data channel between two display drive circuits for pixel data sharing, thereby improving performance of the multi display drive circuit system.

The following describes a host controller and display drive circuits provided in this application.

The host controller provided in this embodiment of this application may be specifically one or more processors. These processors may be integrated on a chip to form a system-on-chip (system on chip, SoC). Designing a circuit structure of the one or more processors or configuring appropriate code may enable the one or more processors to perform the functions of splitting a to-be-displayed image and sending the to-be-displayed image to the display drive circuits as described in the foregoing embodiments.

Figure 11:
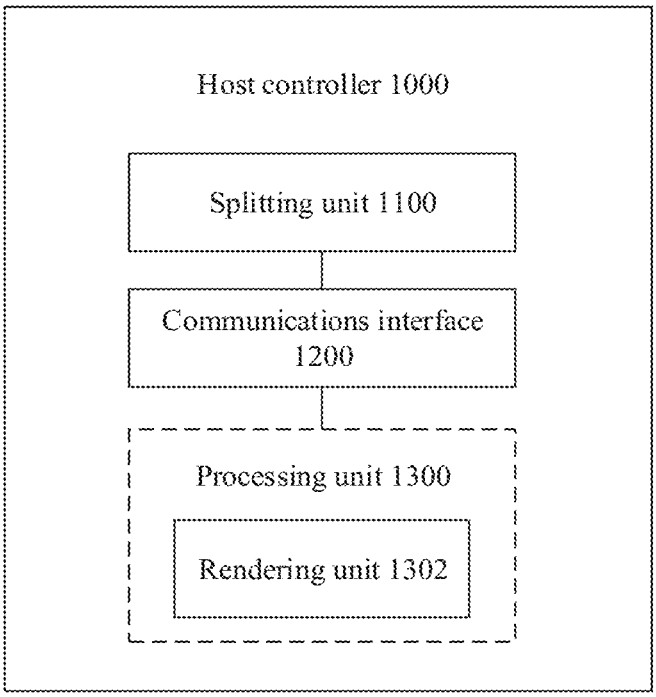
FIG. 11 is a schematic structural block diagram of a host controller according to this application.

FIG. 11 is a schematic structural block diagram of a host controller according to some embodiments of this application. As shown in FIG. 11, the host controller 1000 includes a splitting unit 1100 and a communications interface 1200.

In an implementation, each unit of the host controller 1000 has the following functions:

The splitting unit 1100 is configured to split a to-be-displayed image into at least two sub images in a non sub pixel rendering SPR pixel format, where each sub image and an adjacent sub image thereof include at least one column of overlapping image pixels.

The communications interface 1200 is configured to send the at least two sub images to at least two display drive circuits.

Optionally, there may be one or more communications interfaces 1200. When there are a plurality of communications interfaces 1200, each communications interface 1200 is configured to send one of the at least two sub images to one of the at least two display drive circuits.

In an implementation, the splitting unit 1100 may be a splitter implemented by hardware. The communications interface 1200 may be a DSI interface.

Optionally, in an implementation, the multi display drive circuit system includes a first display drive circuit and a second display drive circuit, where the splitting unit 1100 is configured to split the to-be-displayed image into a first sub image and a second sub image in the non SPR pixel format, where the first sub image and the second sub image include at least one column of overlapping image pixels in the non SPR pixel format; and the communications interface 1200 is configured to send the first sub image to the first display drive circuit, and send the second sub image to the second display drive circuit.

Optionally, in an implementation, a column range of image pixels included in the first sub image is $[1, M+N_1]$, and a column range of image pixels included in the second sub image is $[M-N_2, Z]$, where Z is a total quantity of columns of image pixels included in the to-be-displayed image, Z, M $N_1$, and $N_2$ are all positive integers, $1<M<Z$, and $Z>1$.

Optionally, $N_1=N_2$.

The following describes two display drive circuits used in this application.

Figure 12:
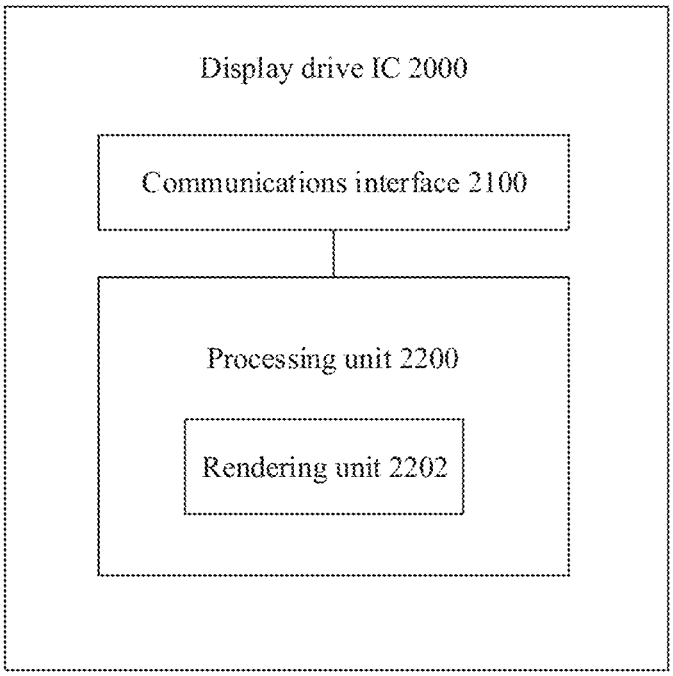
FIG. 12 is a schematic structural block diagram of a display drive circuit 2000.

FIG. 12 is a schematic structural diagram of a display drive circuit 2000. As shown in FIG. 12, the display drive circuit 2000 includes a communications interface 2100 and a processing unit 2200.

The communications interface 2100 is configured to receive a first sub image in a non SPR pixel format from the communications interface 1200 of the host controller 1000, and input the first sub image in the non SPR pixel format to the processing unit 2200.

The processing unit 2200 is configured to drive, based on pixel data of the first sub image in the non SPR pixel format, a display screen to display a part of a to-be-displayed image in an SPR manner.

In an implementation, the processing unit 2000 may include a rendering unit 2202. The rendering unit 2202 is configured to render the first sub image in the non SPR pixel format based on an SPR algorithm, to obtain a part of the to-be-displayed image in an SPR pixel format.

Optionally, in an embodiment, the communications interface 2100 may be a DSI interface.

In addition, a function of the processing unit 2200 may be implemented by hardware, or may be implemented by a combination of software and hardware. When the function of the processing unit 2200 is implemented by hardware, the processing unit 2200 may be a logic circuit, an integrated circuit, or the like. For example, the processing unit 2200 may be a display 26) driver integrated circuit (display driver integrated circuit, DDIC). When implemented by a combination of software and hardware, the processing unit 2200 may be a processor. The processor implements the foregoing function of the processing unit 2200 by reading computer program code or an instruction stored in a storage unit.

Optionally, the storage unit may be integrated into the processor, or may exist independently outside the processor.

Figure 13:
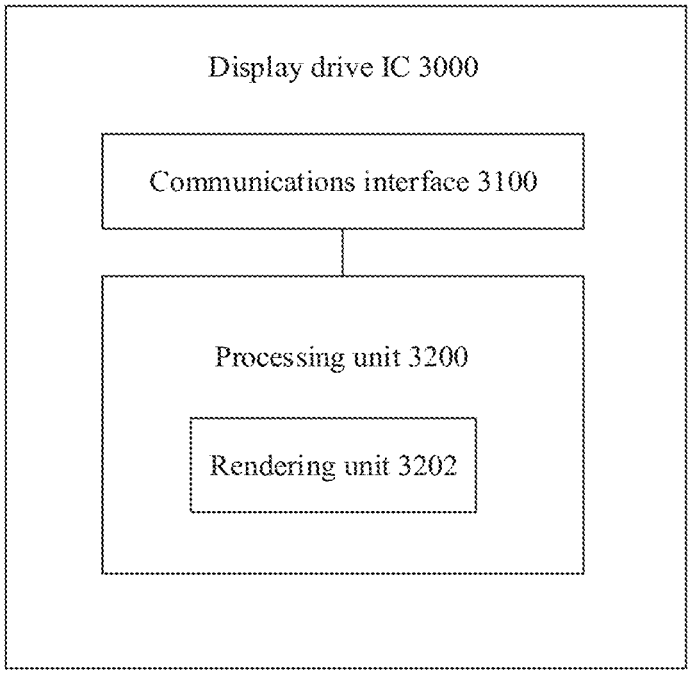
FIG. 13 is a schematic structural block diagram of a display drive circuit 3000.

FIG. 13 is a schematic structural block diagram of a display drive circuit 3000. As shown in FIG. 13, the display drive circuit 3000 includes a communications interface 3100 and a processing unit 3200.

The communications interface 3100 is configured to receive a second sub image in the non SPR pixel format from the host controller 1000, and input the second sub image in the non SPR pixel format to the processing unit 3200.

The processing unit 3200 is configured to drive, based on pixel data of the second sub image in the non SPR pixel format, the display screen to display another part of the to-be-displayed image in the SPR manner.

Optionally, the communications interface 3100 may be a DSI interface, and the processing unit 3200 may be a processor.

In addition, a function of the processing unit 3200 may be implemented by hardware, or may be implemented by a combination of software and hardware. When implemented by hardware, the processing unit 3200 may be a logic circuit, an integrated circuit, or the like. For example, the processor unit 3200 may be a DDIC. When implemented by a combination of software and hardware, the processing unit 3200 may be a processor. The processor implements the function of the processing unit 3200 by reading computer program code or an instruction stored in a storage unit. Optionally, the storage unit may be integrated into the processor, or may exist independently outside the processor.

In another implementation, the host controller 1000 further includes a processing unit 1300.

Optionally, each unit of the host controller 1000 has the following functions:

The processing unit 1300 is configured to render the to-be-displayed image based on the SPR algorithm, and output the rendered image in the SPR pixel format;

the splitting unit 1100 is configured to split the rendered image in the SPR pixel format into at least two sub images in the SPR pixel format; and the communications interface 1200 is configured to send the at least two sub images in the SPR pixel format to at least two display drive circuits respectively.

Optionally, in an implementation, the multi display drive circuit system includes a first display drive circuit and a second display drive circuit, where the processing unit 1300 is configured to generate a third sub image and a fourth sub image in the SPR pixel format based on pixel data of the to-be-displayed image in the non SPR pixel format; and the communications interface 1200 is configured to send the third sub image to the first display drive circuit, and send the fourth sub image to the second display drive circuit.

Optionally, in this embodiment, the processing unit 1300 may include a rendering unit 1302, configured to render the to-be-displayed image based on the SPR algorithm, and output the rendered image in the SPR pixel format.

Optionally, a function of the processing unit 1300 may be implemented by hardware, or may be implemented by a combination of software and hardware. When implemented by hardware, the processing unit 1300 may be a logic circuit, an integrated circuit, or the like, for example, a DDIC. When implemented by a combination of software and hardware, the processing unit 1300 may be a processor. The processor implements the function by reading computer program code stored in a storage unit. Optionally, the storage unit may be integrated into the processor, or may exist independently outside the processor.

In this embodiment, functions of each unit of the display drive circuit 2000 are as follows:

The communications interface 2100 is configured to receive the third sub image in the SPR pixel format from the communications interface 1200 of the host controller; and the processing unit 2200 is configured to drive, based on pixel data of the third sub image in the SPR pixel format, the display screen to display the third sub image in the SPR manner.

Functions of each unit of the display drive circuit 3000 are as follows:

The communications interface 3100 is configured to receive the fourth sub image in the SPR pixel format from the communications interface 1200 of the host controller; and the processing unit 3200 is configured to drive, based on pixel data of the fourth sub image in the SPR pixel format, the display screen to display the fourth sub image in the SPR manner.

The host controller and the display drive circuits provided in this application are described in detail above.

It should be understood that the foregoing embodiment is described by using two display drive circuits. When there are more than two display drive circuits, a function of each display drive circuit is similar to the function of the display drive circuit 2000 or the display drive circuit 3000, and details are not described again.

Figure 14:
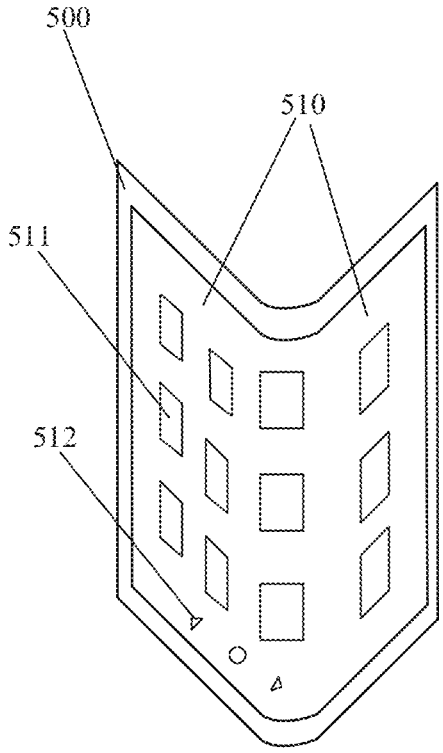
FIG. 14 is a schematic structural diagram of an electronic device 5000 according to this application.

In addition, referring to FIG. 14, this application further provides an electronic device 5000.

FIG. 14 is a schematic structural diagram of an electronic device 5000 according to this application. As shown in FIG. 14, the electronic device 5000 may include a flexible display screen 510, one or more processors (not shown), one or more memories (not shown), and one or more radio frequency circuits (not shown).

The processor is configured to process data, and may be specifically a central processing unit (central processing unit, CPU), or may be another general purpose processor, an application processor (application processor, AP), a baseband processor, a digital signal processor (digital signal processor, DSP), an application specific integrated circuit (application specific integrated circuit, ASIC), a field programmable gate array (field programmable gate array; FPGA) or another programmable logic device, a discrete gate or transistor logic device, a discrete hardware component. The general purpose processor may be a microprocessor or any conventional processor or the like. Specifically, the processors may be integrated on one chip, which is referred to as a system-on-chip.

The memory is configured to store data, and may be specifically a random access memory (random access memory, RAM), a flash memory, a read-only memory (read-only memory, ROM), a programmable read-only memory (programmable ROM, PROM), an erasable programmable read-only memory (erasable PROM, EPROM), an electrically erasable programmable read-only memory (electrically EPROM, EEPROM), a register, a hard disk, or the like.

The radio frequency circuit is configured to receive or transmit a signal, to interact with another device.

The flexible display screen 510 may be the display screen described in the embodiments of this application, for example, the display screen 104. At least one application icon 511 and a virtual button 512 may be displayed on the flexible display screen. The flexible display screen 510 has relatively high rigidity, and may be bent with a given curvature when the flexible display screen is folded or rolled, thereby avoiding wrinkles, arches, or creases caused by folding or rolling, and improving visual experience of a user.

It should be understood that FIG. 14 mainly shows the flexible display screen 510 of the foldable electronic device. For the processor, the memory, the radio frequency circuit, and the like that are included in the foldable electronic device, refer to FIG. 6. In addition, the electronic device 5000 may further include other components shown in FIG. 6. This is not limited in this application.

In addition, this application further provides a circuit system. The circuit system includes one or more processors. The one or more processors are configured to perform processing performed by the host controller in the image display method provided in this application. For details, refer to the method embodiments.

Optionally, this application further provides a circuit system. The circuit system includes one or more processors, and the one or more processors are configured to read and execute a computer program stored in a memory, to perform processing performed by the controller in the image display method provided in this application.

Optionally, the memory may be located outside the circuit system or integrated into the circuit system, and the processor is connected to the memory by using a circuit or a wire. There may be one or more memories.

Further, optionally, the circuit system further includes a communications interface.

This application provides a computer-readable storage medium, where the computer-readable storage medium stores a computer instruction, and when the computer instruction is run on a computer, the computer is enabled to perform the method for displaying an image in a multi display drive circuit system according to this application.

This application provides a computer program product, where the computer program product includes computer program code, and when the computer program code is run on a computer, the computer is enabled to perform the method for displaying an image in a multi display drive circuit system according to this application.

In addition, functional units in the embodiments of this application may be integrated into one processing unit, or each of the units may exist alone physically, or two or more units are integrated into one unit.

A person of ordinary skill in the art may be aware that, in combination with the examples described in the embodiments disclosed in this specification, units and algorithm steps may be implemented by electronic hardware or a combination of computer software and electronic hardware. Whether the functions are performed by hardware or software depends on particular applications and design constraint conditions of the technical solutions. A person skilled in the art may use different methods to implement the described functions for each particular application, but it should not be considered that the implementation goes beyond the scope of this application.

It may be clearly understood by a person skilled in the art that, for the purpose of convenient and brief description, for a detailed working process of the foregoing system, apparatus, and unit, refer to a corresponding process in the foregoing method embodiments, and details are not described herein again.

The units described as separate parts may or may not be physically separate, and parts displayed as units may or may not be physical units, may be located in one position, or may be distributed on a plurality of network units. Some or all of the units may be selected based on actual requirements to achieve the objectives of the technical solutions of the embodiments in this application.

In addition, functional units in the embodiments of this application may be integrated into one processing unit, or each of the units may exist alone physically, or two or more units are integrated into one unit.

When the functions are implemented in the form of a software functional unit and sold or used as an independent product, the functions may be stored in a computer-readable storage medium. Based on such an understanding, the technical solutions of this application essentially, or the part contributing to the prior art, or some of the technical solutions may be implemented in a form of a software product. The software product is stored in a storage medium, and includes several instructions for instructing a computer device (which may be a personal computer, a server, a network device, or the like) to perform all or some of the steps of the methods described in the embodiments of this application.

The foregoing descriptions are merely specific implementations of this application, but are not intended to limit the protection scope of this application. Any equivalent modifications or replacement readily figured out by a person skilled in the art within the technical scope disclosed in this application. The protection scope of this application shall be subject to the protection scope of the claims.

What is claimed is:

1. An electronic device, comprising:

a host controller configured to:

split a to-be-displayed image into at least two sub images in a non-sub pixel rendering (non-SPR) pixel format; and send the at least two sub images, wherein each sub image and an adjacent sub image thereof comprise at least one column of overlapping image pixels; and at least two display drive circuits coupled to the host controller and configured to jointly present the to-be-displayed image on a display screen, wherein each of the at least two display drive circuits is configured to:

receive one of the at least two sub images from the host controller; and drive, based on image pixel data of the one of the at least two sub images, the display screen to display a part of the to-be-displayed image in an SPR manner.

2. The electronic device of claim 1, wherein the at least two display drive circuits comprise a first display drive circuit and a second display drive circuit, wherein the host controller is configured to:

split the to-be-displayed image into a first sub image and a second sub image in the non-SPR pixel format;

send the first sub image to the first display drive circuit; and send the second sub image to the second display drive circuit, wherein the first sub image and the second sub image comprise another at least one column of overlapping image pixels, wherein the first display drive circuit is configured to drive, based on first pixel data of the first sub image in the non-SPR pixel format, the display screen to display a first part of the to-be-displayed image in the SPR manner, and wherein the second display drive circuit is configured to drive, based on second pixel data of the second sub image in the non-SPR pixel format, the display screen to display a second part of the to-be-displayed image in the SPR manner.

3. The electronic device of claim 2, wherein a first column range of image pixels comprised in the first sub image is [1, $M+N_1$], wherein a second column range of image pixels comprised in the second sub image is [$M-N_2$, Z], wherein Z is a total quantity of columns of image pixels comprised in the to-be-displayed image, wherein Z, M, $N_1$, and $N_2$ are all positive integers, wherein $1<M<Z$, and wherein $Z>1$.

4. The electronic device of claim 3, wherein $N_1=N_2$.

5. The electronic device of claim 1, further comprising the display screen, wherein the display screen comprises a plurality of pixels.

6. The electronic device of claim 5, wherein each pixel comprises two sub pixels.

7. The electronic device of claim 6, wherein the two sub pixels comprise a red sub pixel and a green sub pixel.

8. The electronic device of claim 6, wherein the two sub pixels comprise a green sub pixel and a blue sub pixel.

9. The electronic device of claim 6, wherein the two sub pixels comprise a blue sub pixel and a red sub pixel.

10. The electronic device of claim 6, wherein the two sub pixels are combined into on virtual sub pixel.

11. A method for displaying an image in a multiple display drive circuit system, wherein the multiple display drive circuit system comprises a host controller, a display screen, and at least two display drive circuits, and wherein the method comprises:

splitting, by the host controller, a to-be-displayed image into at least two sub images in a non-sub pixel rendering (non-SPR) pixel format;

sending, by the host controller, the at least two sub images to the at least two display drive circuits, wherein each of the at least two sub images and an adjacent sub image thereof comprise at least one column of overlapping image pixels;

receiving, by each of the at least two display drive circuits, one of the at least two sub images from the host controller; and driving, by each of the at least two display drive circuits based on pixel data of the sub image in the non-SPR pixel format, the display screen to display a part of the to-be-displayed image in an SPR manner to jointly present the to-be-displayed image.

12. The method of claim 11, wherein the at least two display drive circuits comprise a first display drive circuit and a second display drive circuit, wherein the method further comprises:

splitting, by the host controller, the to-be-displayed image into a first sub image and a second sub image in the non-SPR pixel format;

sending, by the host controller, the first sub image to the first display drive circuit;

sending, by the host controller, the second sub image to the second display drive circuit, wherein the first sub image and the second sub image comprise at least one column of overlapping image pixels;

driving, by the first display drive circuit, based on first pixel data of the first sub image in the non-SPR pixel format, the display screen to display a first part of the to-be-displayed image in the SPR manner; and driving, by the second display drive circuit, based on second pixel data of the second sub image in the non-SPR pixel format, the display screen to display a second part of the to-be-displayed image in the SPR manner.

13. The method of according to claim 12, wherein a first column range of image pixels comprised in the first sub image is [1, $M+N_1$], wherein a second column range of image pixels comprised in the second sub image is [$M-N_2$, Z], wherein Z is a total quantity of columns of image pixels comprised in the to-be-displayed image, wherein Z, M, $N_1$, and $N_2$ are all positive integers, wherein $1<M<Z$, and wherein $Z>1$.

14. The method of claim 13, wherein $N_1=N_2$.

15. The method of claim 11, wherein the display screen comprises a plurality of pixels, wherein each pixel comprises two sub pixels, wherein the two sub pixels comprise a red sub pixel and a green sub pixel, the green sub pixel and a blue sub pixel, or the blue sub pixel and the red sub pixel.

16. A circuit system, comprising:

a memory configured to store instructions; and a processor coupled to the memory and configured to execute the instructions to cause the circuit system to:

split a to-be-displayed image into at least two sub images in a non-sub pixel rendering (non-SPR) pixel format, wherein each sub image and an adjacent sub image thereof comprise at least one column of overlapping image pixels;

send the at least two sub images to at least two display drive circuits; and drive, based on the at least two sub images in the non-SPR pixel format, a display screen to display the to-be-displayed image in an SPR manner.

17. The circuit system of claim 16, wherein the processor is further configured to execute the instructions to cause the circuit system to:

split the to-be-displayed image into a first sub image and a second sub image in the non-SPR pixel format, wherein the first sub image and the second sub image comprise at least one column of overlapping image pixels;

send the first sub image to a first display drive circuit to drive, based on first pixel data of the first sub image in the non-SPR pixel format, the display screen to display a part of the to-be-displayed image in the SPR manner; and send the second sub image to a second display drive circuit to drive, based on second pixel data of the second sub image in the non-SPR pixel format, the display screen to display another part of the to-be-displayed image in the SPR manner.

18. The circuit system of claim 17, wherein a first column range of image pixels comprised in the first sub image is [1, $M+N_1$], wherein a second column range of image pixels comprised in the second sub image is [$M-N_2$, Z], wherein Z is a total quantity of columns of image pixels comprised in the to-be-displayed image, wherein Z, M, $N_1$, and $N_2$ are all positive integers, wherein $1<M<Z$, and wherein $Z>1$.

19. The circuit system of claim 18, wherein $N_1=N_2$.

20. The circuit system of claim 16, wherein the display screen comprises a plurality of pixels, wherein each pixel comprises two sub pixels, wherein the two sub pixels comprise a red sub pixel and a green sub pixel, the green sub pixel and a blue sub pixel, or the blue sub pixel and the red sub pixel.

* * * * *